United States Patent [19]

Pav et al.

[11] 4,290,351

[45] Sep. 22, 1981

[54] METHOD AND APPARATUS FOR RAPIDLY SEPARATING THE ROLLS OF A CALENDER

[75] Inventors: Josef Pav, Krefeld; Franz Kayser, Geldern; Axel Kemna, Kempen, all of Fed. Rep. of Germany

[73] Assignee: Kleinewefers GmbH, Krefeld, Fed. Rep. of Germany

[21] Appl. No.: 83,632

[22] Filed: Oct. 11, 1979

[30] Foreign Application Priority Data

Oct. 16, 1978 [DE] Fed. Rep. of Germany ..... 2845055

[51] Int. Cl.[3] ..... B30B 3/04; B30B 15/16

[52] U.S. Cl. ..... 100/47; 100/163 A; 100/170

[58] Field of Search ..... 100/35, 47, 163 R, 163 A, 100/164, 165, 168, 169, 170, 171; 72/245

[56] References Cited

U.S. PATENT DOCUMENTS

| | | | |
|---|---|---|---|
| 3,364,848 | 1/1968 | Muller | 100/47 |
| 3,369,483 | 2/1968 | Muller | 100/47 |
| 3,777,656 | 12/1973 | Muller | 100/47 |
| 3,884,140 | 5/1975 | Christ et al. | 100/170 |
| 3,942,434 | 3/1976 | Wenzel | 100/47 |
| 3,948,166 | 4/1976 | Wenzel | 100/168 |

*Primary Examiner*—Peter Feldman

*Attorney, Agent, or Firm*—Peter K. Kontler

[57] ABSTRACT

The lowermost roll of a row of superimposed rolls in the stand of a calender is movable downwardly at a continuously increasing speed through a first distance which suffices to increase the width of clearances between neighboring rolls in the event of breakage of the running web so that the rolls cannot damage each other, and thereupon through a second distance which is at least 50 percent of the first distance. The lowermost roll is braked only during movement through the second distance so that the first distance can be covered, under the action of gravity alone or under the action of gravity plus the action of several double-acting hydraulic cylinders, within a fraction of the time which is required for adequate separation of rolls in a calendar wherein the lowermost roll must be braked during travel through the first distance. The speed of the lowermost roll during movement through the second distance is regulated by flow restrictors which are installed in conduits for evacuation of liquid from the lower chambers of the double-acting cylinders and which are adjustable by a control unit in accordance with a preselected pattern as a function of time and/or as a function of the extent of downward movement of the lowermost roll. The uppermost roll is hydraulically locked against any movement during downward movement of the lowermost roll.

45 Claims, 7 Drawing Figures

METHOD AND APPARATUS FOR RAPIDLY SEPARATING THE ROLLS OF A CALENDER

BACKGROUND OF THE INVENTION

The present invention relates to a method and apparatus for varying the width of clearances between the rolls of a calender. More particularly, the invention relates to a method and apparatus for rapidly increasing the width of clearances between neighboring rolls of a calender wherein the rolls form a normally vertical row of superimposed rolls and at least some of the rolls are movable sideways. Still more particularly, the invention relates to improvements in a method and apparatus for manipulating the rolls of a calender wherein at least one of the outermost rolls can be moved toward and away from the neighboring roll, preferably by pressurized fluid.

It is already known to separate the rolls of a calender which is used for the treatment of webs consisting of paper, textile or synthetic plastic material. Separation is desirable in order to prevent the neighboring rolls from damaging each other in the absence of a web therebetween. The width of clearances which develop upon separation of neighboring rolls should be sufficient to prevent direct contact between such rolls. The interval which is needed to increase the width of clearances should be as short as possible in order to reduce the period of potential damage to the rolls to a minimum. As a rule, the interval which elapses after a web breaks and before the rolls are properly separated from each other should be less than one second. Separation by moving the lower rolls away from the rolls thereabove is preferred at this time because it takes up less time than the lifting of each higher roll above and away from the roll therebelow.

In certain presently known calenders, the bearings for the lowermost roll rest on the pistons of hydraulic cylinders. A detector monitors the running web and transmits a signal which initiates the movement of lowermost roll downwardly and away from the next-to-the-lowermost roll. Such movement is achieved by opening paths for the escape of hydraulic fluid from the chambers below the pistons. For example, the signal from the detector can initiate opening of normally closed solenoid-operated valves in conduits which connect the aforementioned chambers with a tank for hydraulic fluid. The downward strokes of pistons (upon opening of the paths) equal or closely approximate the combined width of clearances between neighboring rolls when the rolls are separated to an extent which is needed or deemed necessary to avoid damage to the rolls in the absence of a web therebetween. The lower end position of the lowermost roll is determined by one or more stops for the pistons, for example, by stops which form part of the cylinders and against which the pistons abut upon completion of their movement in a direction to allow the lowermost roll to descend by gravity and to the extent which is needed for sufficient separation of neighboring rolls from each other. If the lowermost roll is movable between the lower end positions in one of which the rolls are separated sufficiently to avoid damage thereto in the absence of a web therebetween and in the other of which the width of clearances suffices to allow for removal of a roll from the calender frame or stand, the calender comprises one or more removable stops which intercept the pistons for the lowermost roll in the one lower end position and which, when removed, allow the pistons for the lowermost roll to descend to the other lower end position. Alternatively, the calender can be equipped with a limit switch or the like which closes the valves in the paths for the escape of fluid from the aforediscussed chambers when the pistons for the bearings of the lowermost roll reach the one lower end position.

The cylinders for the pistons which support the bearings for the lowermost roll can be designed to allow for raising or lowering of such bearings as well as to furnish the pressure which, in normal operation, is needed to bias the rolls against the web portions which extend through the nips of neighboring rolls. Alternatively, the cylinders for pistons which support the bearings for the lowermost roll can serve the aforediscussed purpose to vary the width of clearances between neighboring rolls in the case of an emergency (normally a break in the running web) as well as to bias the bearings against a stop when the calender is in use. The force with which the rolls bear against the running web is then supplied by another device.

It has been found that the length of intervals which elapse in presently known calenders during separation of the rolls is excessive, i.e., that such intervals are sufficiently long to enable the neighboring rolls to damage each other in the event of breakage of the running web. In such conventional calenders, the length of intervals which are needed for separation of rolls depends on a number of factors, such as the design, number and length of rolls. Furthermore, such intervals are longer than desirable because the movement of the lowermost roll away from the roll thereabove must be braked practically immediately after the lowermost roll begins to move downwardly. The braking action is furnished by the aforementioned valves which control the flow of hydraulic fluid from the chambers of cylinders during downward movement of pistons to thereby lower the bearings for the lowermost roll. The speed of downward movement of the lowermost roll, especially during the last stage of such movement, cannot exceed a certain value because a sudden impact of bearings for the lowermost roll against stationary stops while the bearings descend at a relatively high speed could result in generation of substantial forces (due to inertia of the large mass of material which moves downwardly) which could cause damage to or destroy the lowermost roll and/or its bearings. Moreover, the median portion of the lowermost roll would be likely to flex to such an extent as to strike against the median portion of the roll immediately thereabove. Such rebounding or backlash of the median portion of the lowermost roll could cause more damage than that which develops if the rolls are not separated from each other when the web breaks.

OBJECTS AND SUMMARY OF THE INVENTION

An object of the invention is to provide a novel and improved method of rapidly separating the rolls of a calender without any damage to the rolls and/or their bearings, especially without undue stressing of component parts of the calender.

Another object of the invention is to provide a method which can be resorted to, irrespective of the number of rolls in a calender and regardless of whether the distance between the rolls must be increased by moving the upper outermost roll upwardly and/or by moving the lower outermost roll downwardly.

A further object of the invention is to provide a method which renders it possible to increase the width of clearances between neighboring rolls within a fraction of the time which is needed for such operation in presently known calenders.

An additional object of the invention is to provide a calender with novel and improved apparatus for effecting rapid separation of neighboring rolls.

Another object of the invention is to provide a relatively simple and compact apparatus which can be incorporated in or combined with calenders of known design at a reasonable cost.

A further object of the invention is to provide an automatic apparatus for increasing the width of clearances between neighboring rolls in a calender wherein such separation necessitates upward movement of the uppermost roll and/or downward movement of the lowermost roll.

An ancillary object of the invention is to provide a calender which embodies the above outlined apparatus with novel and improved means for promoting the movement of the one or the other outermost roll away from the nearest roll.

Another object of the invention is to provide the calender with novel and improved means for regulating the speed of that outermost roll which must be moved sideways in order to increase the width of clearances between neighboring rolls.

One feature of the invention resides in the provision of a method of rapidly separating the rolls of a calender wherein a row of normally closely adjacent superimposed rolls includes upper and lower outermost rolls and one of the outermost rolls is movable sideways toward and away from the other rolls to respectively reduce and increase the width of clearances between neighboring rolls and wherein the one outermost roll must move through a predetermined distance in order to allow for adequate separation of all rolls which form the row. The method comprises the steps of (a) moving the one outermost roll at a series of first speeds (e.g., starting with zero speed and gradually increasing to a maximum speed of at least 20 centimeters per second, preferably in excess of 25 centimeters per second), through the aforementioned predetermined distance and in a direction away from the other rolls; and (b) continuing the movement of the one outermost roll in the aforementioned direction at a series of gradually decreasing second speeds (preferably from the aforementioned maximum speed back to zero speed) and through a second distance which is at least 50 percent and can be a multiple of (e.g., between one and one-half and four times) the predetermined distance. This insures that the width of clearances between neighboring rolls can be rapidly increased to the desired value without braking the one outermost roll. The movement of the one outermost roll through the second distance takes place immediately after completion of separation (i.e., without any stoppage) and is accompanied by an appropriate braking action to bring the one outermost roll to a smooth stop without generating excessive forces due to gravity and/or inertia.

The one outermost roll can be the lower outermost roll, i.e., the lowermost roll of the row. The lower outermost roll can be normally held in the operative position (in which the width of clearances between neighboring rolls is minimal, i.e., such as is required for normal operation of the calender) by confining a supply of liquid at a level below the lower outermost roll so that the confined liquid normally prevents movements of the lower outermost roll in the aforementioned direction (downwardly) and the confined liquid is pressurized, at least under the weight of the lower outermost roll. The steps (a) and (b) preferably comprise establishing at least one path for the escape of confined liquid so that the lower outermost roll can descend by gravity. At least the step (b) preferably includes regulating the rate of escape of liquid along the aforementioned path.

The second distance can exceed the predetermined distance to allow for gradual braking or decelerating action all the way to zero speed.

The series of first speeds preferably includes a succession of progressively higher speeds so that the one outermost roll is accelerated, at least during a portion of its movement through the predetermined distance. Such portion may constitute at least the major part of movement of the one outermost roll through the predetermined distance.

The speeds of the series of second speeds preferably decrease at a constant rate so that the one outermost roll is gradually decelerated, at least while covering a substantial portion of the second distance. Such substantial portion preferably constitutes at least the major part of the second distance. As mentioned above, the one outermost roll is preferably decelerated to zero speed during its movement to cover the second distance.

The step (a) can include permitting the lower outermost roll to descend under the action of gravity alone, i.e., without any or with negligible opposition to such action. Alternatively, the lower outermost roll can be accelerated by gravity and simultaneously subjected to the action of pressurized fluid (preferably a hydraulic fluid) to promote its acceleration in a direction (downwardly) to move away from the other rolls.

The maximum speed of the first series of speeds is preferably at least 20 centimeters per second and most preferably in excess of 25 centimeters per second. Such maximum speed is achieved during the last stage of movement of the one outermost roll through the predetermined distance.

The one outermost roll can be moved counter to the aforementioned direction upon completion of the step (b) so as to be in a position of readiness at a relatively short (predetermined) distance from its operative position. Such movement counter to the aforementioned direction is preferably effected by subjecting the one outermost roll to the action of a pressurized fluid.

Still further, the method can comprise the step of holding or locking the other outermost roll against movement in the course of movement of the one outermost roll in the aforementioned direction. As mentioned above, the one outermost roll is normally (but need not be) the lower outermost roll.

The second distance preferably equals or closely approximates that distance which is needed to permit removal of a selected roll of the row from the frame or stand of the calender. This results in substantial savings for control equipment because a calender is normally or invariably provided with means for moving, or allowing the movement of, one of the outermost rolls to a position in which the width of clearances between all of the rolls is sufficient to allow for convenient removal of any selected roll.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
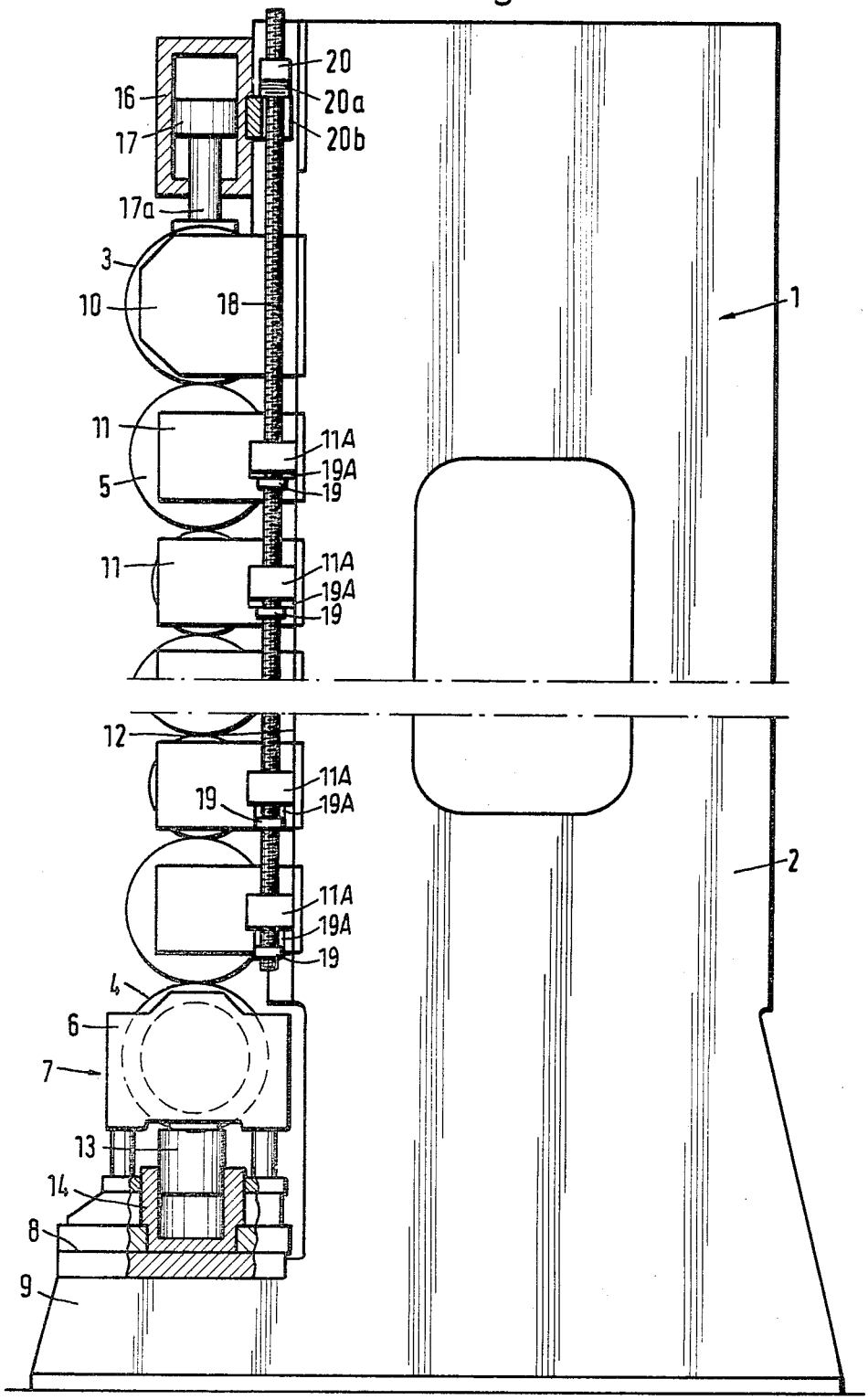
FIG. 1 is a schematic side elevational view of a calender embodying an apparatus which is constructed and assembled in accordance with one form of the invention, a portion of the structure which supports the lowermost roll being shown in section.

The calender which is shown in FIG. 1 comprises a frame or stand 1 including two spaced-apart upright frame members or cheeks 2 (only one shown). The rolls of the calender are supported by and are disposed in front of the frame members 2. These rolls include two outermost rolls 3, 4 and several (e.g., ten) intermediate rolls 5. The roll 3 is the upper outermost or uppermost roll, and the roll 4 is the lower outermost or lowermost roll of the row of twelve rolls. Each of the two bearings 6 (one shown) for the lowermost roll 4 is mounted in a discrete supporting unit 7, and each of these units rests on the top face 8 of a forwardly extending foot portion 9 of the respective frame member 2. The end portions of the uppermost roll 3 are supported in a pair of bearings 10 (one shown), and the end portions of intermediate rolls 5 are supported in pairs of bearings 11 (only one bearing of each pair shown in FIG. 1). The bearings 10 and 11 are slidable along vertical ways or tracks 12 in the front portions of the respective frame members 2. When the calender is in use, the bearings 6 for the lowermost roll 4 are urged against pairs of stationary collars 15 (FIG. 2) or other suitable stops which form part of the respective supporting units 7. The means for biasing the bearings 6 against the respective pairs of stops 15 comprises two hydraulic motors having single-acting cylinders 14 for vertically movable pistons 13. When the bearings 6 abut against the respective pairs of stops 15, the lowermost roll 4 is held in the upper end position in which the width of clearances between neighboring rolls 3, 5 or 5, 5 or 5, 4 is zero or close to zero, so that the peripheral surfaces of such rolls engage the respective sides of a running web (not shown). The bias which is needed to enable the rolls 3, 5 and 4 to apply requisite pressure to the running web is furnished by two upper hydraulic motors including cylinders 16, 116, pistons 17, 117 and piston rods 17*a*, 117*a* (see also FIG. 4). The lower end portions of these piston rods are connected to the respective bearings 10 for the uppermost roll 3. The motors including the cylinders 16 and 116 can be replaced with other types of means for biasing the rolls against the running web. For example, such biasing means may include springs or other mechanical components which urge the bearings 10 downwardly so that the peripheral surface of the roll 3 is biased against the upper side of that portion of the running web which extends through the nip of the roll 3 and the nearest intermediate roll 5.

The frame members 2 carry upright suspension spindles 18 (one shown in FIG. 1) which support abutments or stops 19 for the bearings 11 of intermediate rolls 5. The spindles 18 carry nuts 20 which abut against stationary collars 20*b* of the respective frame members 2. Suitable resilient braking elements 20*a* are preferably interposed between the nuts 20 and the adjacent collars 20*b*. Such braking elements may comprise shock absorbing blocks made of rubber and flanked by metallic plates. Reference may be had to page 385 of the German-language publication entitled "Lexikon der Technik" by Lueger (vol. 15, 1971) which describes and shows braking or shock absorbing elements capable of being used in the calender of FIG. 1.

When the pistons 13 are permitted to descend, i.e., when the lowermost roll 4 is allowed to move in a direction downwardly and away from the uppermost roll 3, the bearings 11 for the intermediate rolls 5 come to rest on the stops 19 which are adjustably mounted on the spindles 18 so that the neighboring rolls 3, 5; 5, 5; 5, 4 are properly spaced apart from each other. The uppermost roll 3 is preferably held against any movement (upwardly or downwardly). The manner in which this can be achieved while the lowermost roll 4 moves downwardly will be explained with reference to FIG. 4.

In their simplest form, the stops 19 may constitute hexagonal nuts which mate with the respective spindles 18 and can be adjusted by a wrench or the like so as to intercept the respective bearings 11 in optimum positions, i.e., in such positions that the width of spaces or clearances between neighboring rolls is sufficient to avoid damage to the rolls in the absence of a running web in the calender. Alternatively, the adjustment of stops 19 can be simplified, for example, in a manner as disclosed in commonly owned British Pat. No. 1,493,025. The spindles of the calender which is disclosed in this patent comprise interconnected screw elements individually associated with each intermediate roll and having support members for the roll bearings. FIG. 7*a* of the British patent shows a worm drive which can rotate a screw element. The worm drive can receive torque from a motor. Still further, it is possible to employ two one-piece spindles and to rotate such spindles by motors mounted at the top of the frame 1. These stops (nuts) 19 which require axial adjustment are then held against rotation with the respective spindles. Regardless of the exact mode of adjusting the stops 19, the arrangement is such that, when the lowermost roll 4 is allowed to descend, the uppermost intermediate roll 5 descends through a first distance, the next roll 5 descends through a greater second distance, and so forth, so as to insure that the width of clearances between the rolls 3, 5; 5, 5; 5, 4 is increased uniformly or nearly uniformly.

FIG. 1 further shows braking or shock absorbing elements 19A which are interposed between the annular portions 11A of bearings 11 for the intermediate rolls 5 and the associated stops 19. In their simplest form, the elements 19A may consist of stacks of dished springs. Alternatively, the elements 19A may consist of annular cushions of the type described and shown in the aforementioned publication of Lueger. Thus, each element 19A may comprise an annular rubber block which is flanked by metallic washers. Such washers are vulcanized or otherwise bonded to the rubber block. Braking or shock absorbing elements 19A of the just described type can perform a highly satisfactory damping action. Furthermore, it is possible to utilize fluid (hydraulically or pneumatically) operated braking or shock absorbing elements.

Figure 2:
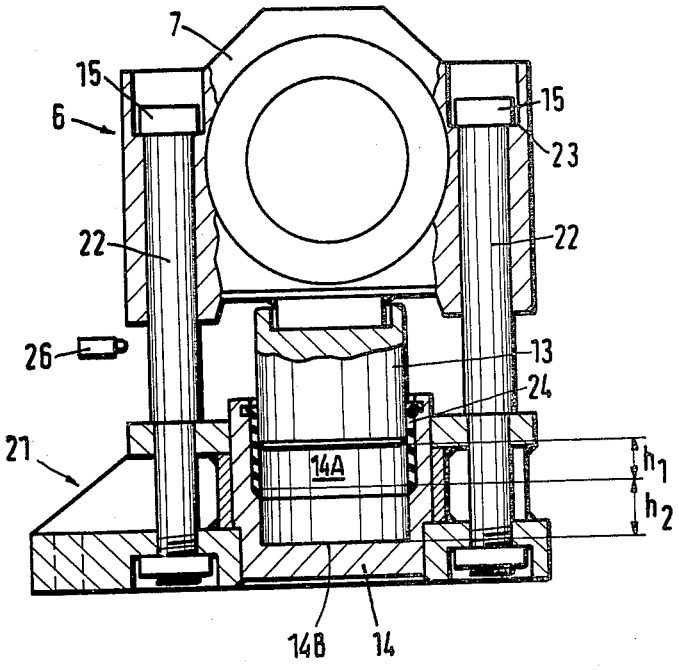
FIG. 2 is an enlarged vertical sectional view of the structure which supports one end portion of the lowermost roll.

As shown in FIG. 2, the lower portion of base 21 of each supporting unit 7 (such lower portion rests on the top face 8 of the respective foot portion 9) supports or includes the comprising hydraulic cylinder 14. The means (bolts, screws or the like) for securing the lower portion 21 to the corresponding foot portion 9 is not shown in the drawing. The lower portion 21 further carries two upright posts or tie rods 22 which flank the respective cylinder 14. The tie rods 22 guide the corresponding bearing 6 for the lowermost roll 4, and their upper end portions constitute or are rigidly connected with the aforementioned stops 15. When the bearing 6 of FIG. 2 is held in the illustrated upper end position (in which the width of clearances between neighboring rolls is reduced to a minimum), the internal surfaces 23 of the bearing 6 abut against the stops 15.

The cylinder 14 comprises an annular sealing element 24 for the piston 13. The chamber for the piston 13 is shown at 14A; this chamber is filled with oil or another suitable hydraulic fluid which is confined in the cylinder 14 and is preferably maintained under sufficient pressure to insure that the internal surfaces 23 invariably abut against the stops 15 when the calender is in use.

The lower portion 21 of the supporting unit 7 shown in FIG. 2 preferably carries a contactless proximity detector switch 26 which is actuated by the descending bearing 6 to transmit an electric signal when the lowermost roll 4 descends through a preselected distance. For example, the switch 26 can transmit a signal when the underside of the bearing 6 shown in FIG. 2 descends to the general level of this switch.

FIG. 2 further shows the distance h1 which the bearing 6 must cover during movement in a direction away from the other rolls in order to insure that the width of clearances between neighboring rolls suffices to prevent or greatly reduce the likelihood of damage to the rolls in the absence of a running paper, textile or plastic web. The total downward stroke of the roll 4 equals h1+h2 wherein h2 is a second distance covered by the roll 4 while the speed of downward movement of the bearings 6 decreases (preferably from a maximum speed of at least 20 centimeters per second and most preferably in excess of 25 centimeters per second upon completion of downward movement through the distance h1) to zero speed (when the movement through the combined distance h1+h2 is completed). The distance h2 preferably equals at least 50 percent of the distance h1 and can be several times (e.g., between one and one-half and four times) the distance h1. In accordance with a presently preferred embodiment of the invention, the combined distance h1+h2 suffices to allow for convenient removal of a selected roll 3, 4 or 5 from the frame or stand 1. Thus, when the roll 4 has descended through the distance h1+h2, the width of clearances between neighboring rolls suffices to allow for convenient removal of any (intermediate or outermost) roll from the machine. The distance h2 is the so-called braking distance, i.e. the roll 4 is intentionally decelerated while descending beyond the point (completion of downward movement through the distance h1) which is needed to avoid damage to or any contact between neighboring rolls when the web breaks or is absent from the customary sinusoidal path (defined by the rolls 3, 5, 4) for another reason.

Figure 3:
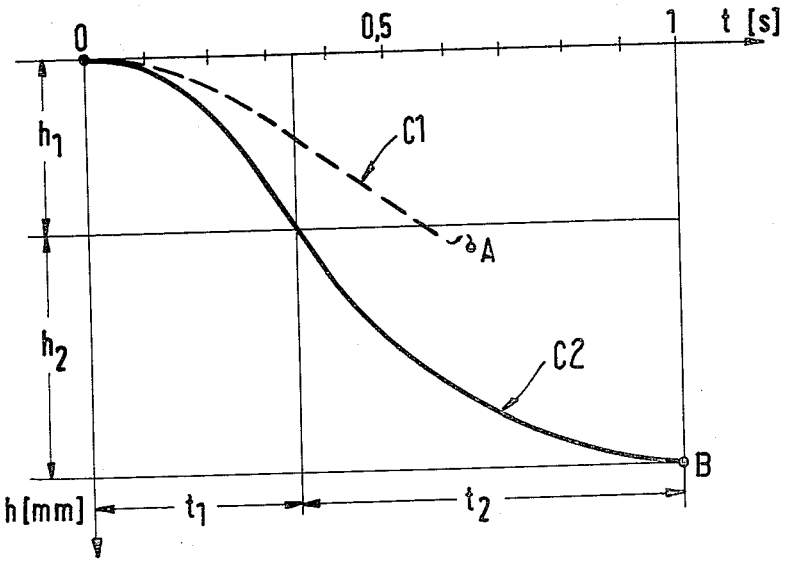
FIG. 3 is a diagram showing the manner in which the lowermost roll is moved away from the nearest roll (a) in accordance with conventional procedures and (b) in accordance with the present invention.

FIG. 3 shows the rate of descent of the lowermost roll in a conventional calender and the manner in which the roll 6 descends in a calender embodying the apparatus of the present invention. The dotted-line curve C1 depicts the progress of the lowermost roll in a presently known calender. The time (t) in seconds is measured along the abscissa, and the distance (h) in millimeters is measured along the ordinate. Starting from the zero point (0) of the coordinate system, the curve C1 slopes gradually downwardly and thereupon includes a straight portion denoting that the speed of the lowermost roll increases gradually until its bearings strike against stationary stops (not shown). The bearings then rebound (as shown at A) and come to rest in positions of contact with the respective stops. A signal to move the bearings for the lowermost roll downwardly (more accurately stated, to allow such bearings to descend by gravity) is generated at the zero point 0. As mentioned before, such signal can be generated when the web breaks and the signal initiates an opening of paths for the flow of confined liquid from cylinder chambers below the lowermost roll. The distance through which the lowermost roll in a conventional calender descends equals or approximates h1. Such lowermost roll comes to a halt because its bearings or the pistons for such bearings strike against stationary stops. Alternatively, downward movement of the lowermost roll can be terminated by resealing the paths for outflow of hydraulic fluid from the cylinders for the pistons which support the bearings for the lowermost roll. The means for generating a signal to close or seal such paths may include a detector which is a functional equivalent of the switch 26 shown in FIG. 2.

Since the bearings for the lowermost roll of a conventional calender rebound on impact against stationary stops (as shown at A in FIG. 3), the median portion of the lowermost roll is or can be flexed to such an extent as to strike against the adjacent intermediate roll. This can result in damage to both rolls as well as in damage to the corresponding bearings, especially the bearings for the lowermost roll.

Attempts to reduce the likelihood of damage as a result of impact of lowermost bearings against stationary stops and resulting flexing of the lowermost roll include the provision of braking devices which decelerate the bearings for the lowermost roll during downward movement through the distance h1. More specifically, the braking devices prevent excessive acceleration of the lowermost roll so that the speed of this roll at the point A is sufficiently low to reduce the likelihood of excessive flexing and ensuing whiplash (upward movement of median portion of the lowermost roll) with attendant impact against the median portion of the lowermost intermediate roll. This is denoted by the straight intermediate portion of the curve C1. When the bearings for the lowermost roll rest on pistons in hydraulic cylinders, the speed of downward movement of such bearings can be regulated by flow restrictors which control the rate of outflow of hydraulic fluid from the cylinder chambers. Such mode of operation invariably necessitates relatively long intervals for downward movement of the lowermost roll throught the distance h1.

The curve C2 of FIG. 3 denotes the movement of lowermost roll 4 through the distance h1 and immediately thereafter (i.e., without any stoppage) through the distance h2. It will be noted that the descending roll 4 covers the distance h1 within an interval t1 which is much shorter than the interval needed to allow for movement of the lowermost roll in a conventional calender through the same distance (h1). In the example of FIG. 3, the roll 4 covers the distance h1 within less than four tenths of one second. On the other hand, the lowermost roll in a conventional calender covers the distance h1 within an interval of more than six tenths of one second.

The speed of the roll 4 during travel through the distance h1 can increase under the action of gravity, i.e., such speed can increase gradually from zero speed (at the point 0) to a speed of not less than 20 centimeters per second and preferably in excess of 25 centimeters per second.

The braking or decelerating action upon the roll 4 and it bearings 6 takes place during the next-following stage of downward movement through the distance h2. The distance h2 can be readily selected in such a way that the deceleration of parts 4 and 6 is gradual, preferably so that the speed of the roll 4 gradually decreases from the maximum speed (upon completion of downward movement through the distance h1) to zero speed. This insures that there is no rebounding when the lower end portion of the piston 13 shown in FIG. 2 comes in contact with the bottom surface 14B in the cylinder chamber 14A. This takes place when the roll 4 reaches the position B of FIG. 3. Consequently, the roll 4 is not flexed at all or its median portion is flexed only to an extent which is a small fraction of the width of clearance between the roll 4 and the adjacent roll 5 when the bearings 11 for such roll 5 abut against the corresponding stops 19 and the roll 4 reaches the position B of FIG. 3. This Figure shows that the roll 4 reaches the position B after elapse of an interval t1+t2. The roll 4 is assumed to form part of a row of twelve superimposed rolls.

By shortening the interval (t1) for downward movement of the roll 4 to less than four tenths of a second, the improved apparatus greatly reduces the likelihood of damage to the rolls 3, 4 and/or 5 after the web breaks because damage is most likely to occur during downward movement of the lowermost roll, i.e., during the period following breakage of the web (and the generation of a signal which initiates downward movement of the lowermost roll) and the instant when the descending lowermost roll completes its movement through the distance h1.

Figure 4:
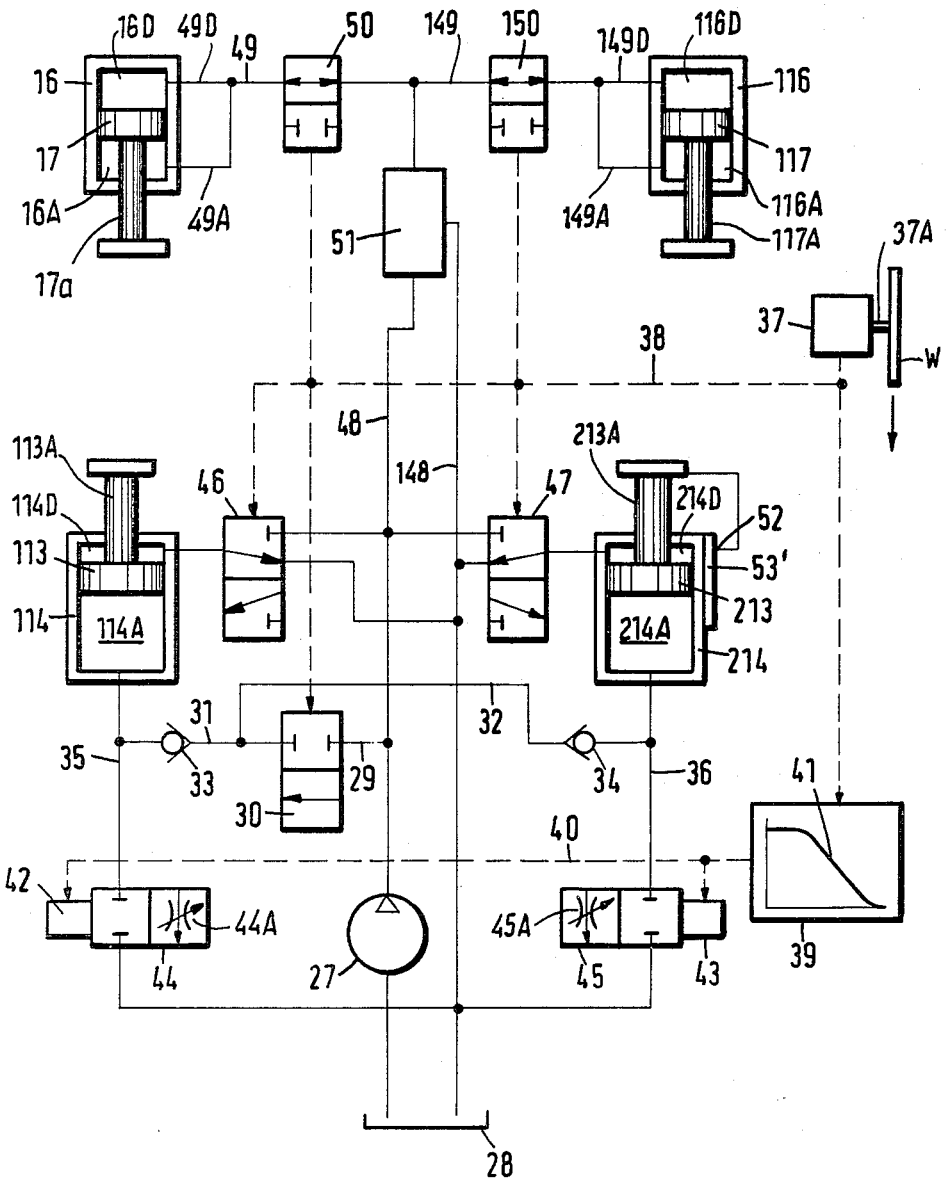
FIG. 4 illustrates the hydraulic and electric circuits of a slightly modified apparatus.

FIG. 4 shows a portion of a modified apparatus. The main difference between the apparatus of FIGS. 1-2 on the one hand and the apparatus of FIG. 4 on the other hand is that the pistons 113, 213 (FIG. 4) for the bearings (not shown) of the lowermost roll are installed in double-acting cylinders 114, 214 so that the speed of downward movement of the lowermost roll (during travel through the distance h1) can be increased beyond that speed at which the lowermost roll descends under the action of gravity. The piston rods 113A, 213A of the pistons 113, 213 are coupled to the corresponding bearings 6 so that they can positively move the lowermost roll upwardly as well as downwardly.

A pump 27 draws hydraulic fluid (e.g., oil) from a tank 28 or another suitable source and delivers pressurized fluid to a supply conduit 29 which contains a shut-off valve 30. When the valve 30 is open, pressurized fluid can enter the lower chambers 114A, 214A of the cylinders 114, 214 via branch conduits 31, 32 and corresponding one-way or check valves 33, 34. The branch conduits 31, 32 of the supply conduit 29 discharge into return conduits 35, 36 which respectively connect the tank 28 with the lower cylinder chambers 114A, 214A. The return conduits 35, 36 respectively contain normally closed flow restricting valves 44, 45 whose solenoids 42, 43 can be energized in response to signals transmitted by a control unit 39. The pistons 113, 213 move upwardly when the valves 44, 45 are closed and the valve 30 is open to establish a path for the flow of pressurized fluid from the supply conduit 29 into the branch conduits 31, 32. The pistons 113 and 213 remain in raised positions (in which the surfaces 13 of the bearings 6 abut against the respective stops 15) when the valves 30, 44, 45 are closed and the chambers 114A, 214A are filled with fluid. The valve 30 can remain open during operation of the calender in order to compensate for eventual losses in hydraulic fluid due to leakage. The surplus of pressurized fluid which is delivered by the pump 27 is returned to the tank 28 by way of a conventional pressure relief (safety) valve, not shown.

The reference character 37 denotes a detector which monitors the path of the running paper, textile or plastic web W and transmits a signal when the web W breaks, i.e., when the tensional stress upon the web changes. For example, the detector 37 may constitute a simple switch whose moving contact 37A is normally depressed by the running web W. When the tensional stress upon the web is reduced (e.g., as a result of breakage), the switch 37 closes and transmits a signal to the aforementioned control unit 39 as well as to the valve 30. The valve 30 closes or remains closed during the ensuing downward movement of pistons 113, 213 through the combined distance h1+h2. The conductors which connect the switch 37 with the control unit 39 and valve 30 (as well as with certain additional components of the apparatus of FIG. 4) are shown by broken lines, as at 38. The conductors which connect the output of the control unit 39 with the solenoids 42, 43 (input elements of valves 44, 45) are shown at 40. The curve 41 denotes the manner in which the control unit 39 is programmed to regulate the adjustable flow restrictors 44A, 45A of the valves 44, 45, so that the flow restrictors offer minimal resistance to the outflow of fluid from the chambers 114A, 214A while the pistons 113, 214 descend through the distance h1, and that the resistance to evacuation of fluid from the chambers 114A, 214A increases gradually to the maximum resistance (speed of downward movement of the lowermost roll 4 reduced to zero speed) while the pistons 113, 213 move downwardly through the distance h2. For example, the control unit 39 may comprise at least one timer which is assembled of one or more RC-links (note T1 in FIG. 5).

The control unit 39 can be replaced with or may include a potentiometer 53 whose wiper 52 is movable by one of the pistons 113, 213, i.e., as a function of movement of the lowermost roll 4.

The immediate result of transmission of a signal via conductor means 40 is that the flow restrictors 44A, 45A are fully open and allow the fluid to flow from the chambers 114, 214, via conduits 35, 36 and into the tank 28 at a maximum rate. This is denoted by the horizontal upper left-hand portion of the curve 41. The control unit 39 begins to adjust the flow restrictors 44A, 45A after elapse of the interval t1 (FIG. 3) so that the valves 44, 45 gradually decrease the speed of the descending pistons 113, 213 during movement through the distance h2. This is denoted by the downwardly sloping portion of the curve 41. The gradually increasing braking action of the flow restrictors 44A, 45A suffices to arrest the lowermost roll 4 at the point B (FIG. 3).

The valves 44 and 45 are commercially available devices which can be purchased together with the associated solenoids 42, 43. By varying the current which is supplied to the coils of the solenoids 42, 43, the rate of liquid flow through the valves 44, 45 can be regulated within a desired range, in the present instance between the maximum rate and zero flow. The control unit 39 constitutes or is the functional equivalent of an amplifier for such valves. When the input of the amplifier receives a signal (from the detector 37), it supplies current to the solenoids 42 and 43 in accordance with a preselected pattern as a function of time. For example, the valves 44, 45 may be of the type known as 4 WRZ 25 manufactured and sold by G. L. Rexroth GmbH, Lohr-/Main, Federal Republic Germany. The amplifier (control unit 39) can be of the type known as VT-3000 (also manufactured and sold by Rexroth). Reference may be had to data sheets RD 29914/1-78 and RD 29382/2-78 and to the pamphlet entitled "Technik von Rexroth," 4 WRZ (pages 48, 49) which describe and illustrate the aforementioned valves and the amplifier of Rexroth.

Other suitable types of valves which can be used in the apparatus of FIG. 4 to regulate the flow of fluid from the cylinder chambers 114A and 214A are known as "8994000 Entlastungsventil P 40" (manufactured and sold by Garbe, Lahmeyer & Co., AG, Aachen, Federal Republic Germany). Such valves can be furnished with electromagnetic and hydraulic control units.

The upper chambers 114D, 214D of the double-acting cylinders 114, 214 can be connected with an extension 48 of the supply conduit 29 or with a return conduit 148 by valves 46 and 47. These valves normally connect the chambers 114D, 214D with the tank 28. However, when the valves 46, 47 receive a signal from the detector 37, they connect the chambers 114D, 214D with the supply conduit 29, 48, so that pressurized fluid which is delivered by the pump 27 assists the force of gravity during downward movement of the roll 4 through the distance h1. This further reduces the length of the interval t1. A suitable time (not shown) can initiate return movement of valves 46, 47 to the illustrated positions after elapse of the interval t1 (following the transmission of a signal from the detector 37). This insures that the braking action of valves 44, 45 need not overcome the pressure of hydraulic fluid in the chambers 114D, 214D while the roll 4 descends through the distance h2.

The cylinders 16 and 116 of the motors which serve to urge the uppermost roll 3 downwardly have chambers 16A, 16D and 116A, 116D. These chambers respectively receive pressurized hydraulic fluid from conduits 49, 149 which respectively contain shutoff valves 50, 150. The conduits 40, 149 are connected with the supply conduit 29, 48 by a pressure-responsive regulator 51 which is further connected with the tank 28 via return conduit 148. The conduit 49 has branches 49A, 49D which respectively communicate with the chambers 16A, 16D. Branches 149A, 149D of the conduit 149 communicate with the corresponding chambers 116A, 116D of the cylinder 116.

When the valves 50, 150 receive a signal from the detector 37, i.e., when the web W breaks, the outlet of the regulator 51 is immediately sealed from the chambers of the cylinders 16 and 116. Thus, the valves 50, 150 close, but they still allow the chambers 16A, 116A to respectively communicate with the chambers 16D, 116D. The entrapped fluid holds the uppermost roll 3 against any movement toward or away from the nearest roll 5. The piston rods 17A, 117A of the pistons 17, 117 are bolted, screwed or otherwise connected to the uppermost bearings 10. The roll 3 remains locked while the roll 4 descends through the combined distance h1+h2.

In normal operation of the calender, the valves 50, 150 are open so that the cylinders 16, 116 receive fluid from the outlet of the pump 27. Since the effective areas of upper sides of the pistons 17, 117 are larger than the effective areas of the undersides of these pistons, the piston rods 17A, 117A urge the bearings 10 downwardly so that the roll 3 bears against the upper side of the web between the roll 3 and the nearest roll 5 with a desired force. Such force can be selected, with a high degree of accuracy, by appropriate adjustment of the regulator 51. This regulator can comprise or constitute a relief valve which admits some fluid into the conduits 49, 149 and directs the remaining fluid (furnished by the extension 48) into the return conduit 148.

The details of the regulator 51 are not shown because the exact construction of such component forms no part of the present invention. This regulator serves to reduce the pressure of fluid which flows into the conduits 49, 149 to a value which is needed for the application of requisite downwardly oriented force to the uppermost roll 3. The regulator 51 can vary the pressure in the conduits 49, 149 in a number of different ways. For example, the regulator can comprise a valve housing or body for a reciprocable spool, one end face of which is biased by a spring (whose bias is adjustable) and the other end face of which is acted upon by the pressure of fluid in the conduits 49 and 149. The spool controls the rate of flow of fluid from the extension 48 into the return conduit 148, and such rate varies in response to axial adjustment of the spool under the bias of or against the opposition of the aforementioned spring.

Alternatively, the regulator 51 may comprise a solenoid-operated valve which is controlled by a pressure-responsive switch in one of the conduits 49, 149. The valve opens whenever the pressure of fluid in the conduits 49, 149 drops below a preselected value.

If desired, the valves 44 and 45 can merely perform the function of varying the rate of outflow of fluid from the respective chambers 114A, 214A. The apparatus of FIG. 4 then comprises two additional valves which seal the conduits 35, 36 when the liquid is to be confined in the chambers 114A, 214A. The construction which is shown in FIG. 4 is preferred at this time because the components 44, 45 can be used as means for regulating the outflow of liquid from the chambers 114A, 214A and constitute shutoff valves which terminate the outflow of liquid upon completion of downward movement of the roll 3 through the combined distance h1+h2 or which hold the roll 4 in the uppermost position when the calender is in actual use.

The solenoids 42, 43 constitute the input elements of the valves 44, 45 and serve to change the rate of fluid flow through the flow restrictors 44A, 45A in response to signals which are transmitted by the control unit 39 via conductor means 40. The rate of adjustment of flow restrictors 44A, 45A is proportional to variation of the intensity or another characteristic of the signal or signals transmitted via conductor means 40. The potentiometer 53' of FIG. 6 can be used to initiate the adjustment of flow restrictors 44A, 45A when the lowermost roll 4 completes its downward movement through the distance h1. In the absence of such potentiometer (which is adjustable as a function of changes in the position or level of the roll 4, bearing 6 and/or pistons 13 or 113, 213), the adjustment of flow restrictors 44A, 45A upon completion of downward movement of the roll 4 through the distance h1 is initiated by the timer switch Z1.

The valves 44, 45 can be replaced with a single shutoff valve which embodies suitably designed adjustable flow restrictor means. The provision of two discrete shutoff valves, one for each of the cylinders 114, 214, is preferred at this time because it renders it possible to further reduce the resistance to the flow of fluid from the chambers 114A, 214A during downward movement of the roll 4 through the distance h1 and, moreover, it is possible to achieve more predictable downward movement of the roll 4 at a series of constantly increasing speeds during the interval t1 and at a series of constantly decreasing speeds during the interval t2.

The provision of check valves 33, 34 in the branches 31, 32 of the supply conduit 29 is desirable and advantageous because they insure that the valves 44, 45 can be adjusted independently of each other in spite of the presence of a single supply conduit 29 for both cylinders 114, 214 whose pistons 113, 213 effect the movements of lowermost roll 4 toward or away from the nearest intermediate roll 5.

It will be readily appreciated that the speed of downward movement of the lowermost roll 4 during the interval t1 determines or strongly influences the speed of downward movement of intermediate rolls 5 so as to move their bearings 11 into indirect engagement with the respective stops 19. The engagement is indirect because of the interposition of braking elements 19A. The maximum speed of the uppermost intermediate roll 5 during movement of its bearing 11 toward the respective stop 19 is less than the maximum speed of the next-to-the-uppermost intermediate roll 5 because the interval of downward movement of the uppermost roll 5 (and hence the acceleration of such roll from zero speed) is shorter than the interval of downward movement of the next-to-the-uppermost roll 5, and so forth. Moreover, the mass of intermediate rolls 5 (or at least some intermediate rolls) is often less than the mass of the lowermost roll 4. Thus, and insofar as the danger of damage to the rolls is concerned, it is sufficient to ascertain the acceptable or safe upper limit of the maximum speed of downward movement of the lowermost roll 4 because the speed of intermediate rolls 5 is less for the just outlined reason. The danger of damage to the bearings 11 and/or intermediate rolls 5 is further reduced or eliminated by the provision of braking elements 19A. The uppermost roll 3 is subjected to negligible stresses (if any) while the lowermost roll 4 descends through the combined distance h1+h2 and the intermediate rolls 5 descend to move their bearings 11 into indirect engagement with the respective stops 19. This is due to the fact that the valves 50, 150 can be actuated to lock the bearings 10 for the uppermost roll 3 against any displacement during sidewise movement of the other rolls, either toward or away from the roll 3.

The motors including the cylinders 16 and 116 serve or can serve additional useful purposes. For example, and as explained above, when the upper chambers 16D, 116D receive pressurized fluid, the roll 3 applies the necessary pressure to insure satisfactory treatment of a running web W as a result of contact with the rolls 3–5. Such pressure can be regulated with a high degree of accuracy in view of the provision of regulator means 51. Furthermore, the motors including the cylinders 16, 116 can be used to accurately select the normal position of the uppermost roll 3 when the calender is in actual use. Still further, these motors can be used to lift the uppermost roll 3 above its normal position preparatory to removal of this roll or of the uppermost intermediate roll 5.

The purpose of the braking elements 19A is somewhat similar to that of the valves 44 and 45, i.e., the elements 19A prevent the portions 11A of the bearings 11 from striking against the stops 19 with a force which would suffice to cause undesirable flexing, vibration and/or other stray movements of the rolls 5. As mentioned above, the relatively simple braking elements 19A in the form of dished springs or shock absorbers including rubber blocks between metallic plates can be replaced with more sophisticated (e.g., pneumatic or hydraulic) braking elements, one for each bearing 11.

The invention can be embodied with equal advantage in calenders whose construction deviates from that of the calender shown in FIGS. 1 and 2. For example, clearances between neighboring rolls can be established by moving the uppermost roll 3 upwardly through a combined distance h1+h2. Furthermore, the cylinders 16, 116 can be omitted; the cylinders 114, 214 are then designed to apply pressure which the piston rods 17A, 117A of FIG. 4 apply to the uppermost roll 3 when the calender is in use. Still further, the number of rolls in the calender can vary within a wide range. Thus, whereas the invention can be embodied with particular advantage in calenders having a substantial number of rolls (more than five), the number of rolls can be reduced to five or less than five without departing from the spirit of the invention. Finally, the control unit 39 can be modified in a number of ways, for example, so that it cooperates with or embodies the proximity detector 26 of FIG. 2. This detector 26 transmits a signal to initiate the start of adjustment of the flow restrictors 44A, 45A (note the downwardly sloping portion of the curve 41 shown in FIG. 4).

Figure 5:
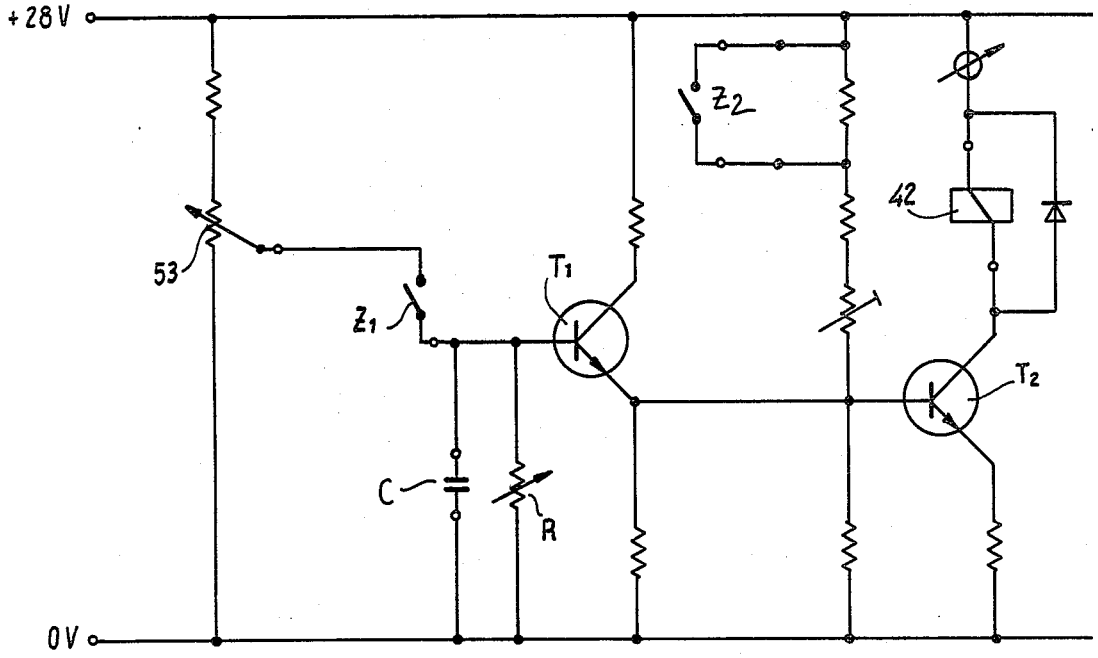
FIG. 5 is a diagrammatic view of a slightly modified electronic control unit for use in the apparatus of FIG. 4.

FIG. 5 shows the details of the control unit for the valves of the types manufactured and sold by Garbe, Lahmeyer & Co., AG. This control unit comprises a timer switch Z1 which closes for a short interval of time when the detector 37 transmits a signal denoting that the web W is damaged or broken. Such closing results in rapid charging of the capacitor C which forms part of the RC-link in the control unit of FIG. 5. Furthermore, closing of the timer switch Z1 results in energization of a first transistor T1 which energizes a second transistor T2 in circuit with the solenoid 42 for the valve 44. The amperage of current flowing through the winding of the solenoid 42 rises with increasing charge of the capacitor C. When the timer switch Z1 opens again, the capacitor C discharges gradually via resistor R whereby the base voltage at the transistor T1 and hence also the current flowing through the winding of the solenoid 42 decreases. The valve 44 opens rapidly during abrupt charging of the capacitor C and closes gradually during gradual discharge of this capacitor. Thus, the circuit of FIG. 5 enables the control unit 39 to regulate the opening and closing of the valve 44 in accordance with the curve 41. The same applies for the valve 45.

The circuit of FIG. 5 further comprises a second timer switch Z2 which closes for an interval of several seconds, either independently of closing of the switch Z1 or in response to a signal from the detector 37 (i.e., simultaneously with closing of the switch Z1). The function of the timer switch Z2 is to insure gradual, slow and linear downward movement of the rolls 3, 4 and 5 in a manner as is required to insure the development of clearances of requisite width in the event of emergency stoppage or when the rolls are to be moved apart without any emergency stop.

Figure 6:
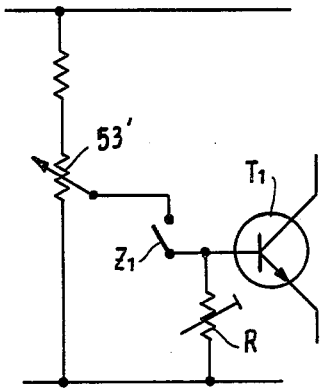
FIG. 6 shows a portion of another control unit.

In the circuit of FIG. 5, the potentiometer 53 is fixed and serves to adjust the voltage for the RC-link. Alternatively, and as shown in FIG. 6, the potentiometer 53' (shown in FIG. 4) can replace the RC-link shown in FIG. 5. The potentiometer 53' of FIG. 6 is adjustable by the piston movement. When the pistons 113, 213 descend, the voltage at the wiper of the potentiometer 53' decreases. This enables the circuit including the components of FIG. 6 to control the operation of the valves 44, 45 in accordance with the curve 41, i.e., it insures gradually accelerated descent of the lowermost roll 4 during the interval t1 and gradually braked or decelerated descent of the roll 4 during the interval t2.

Figure 7:
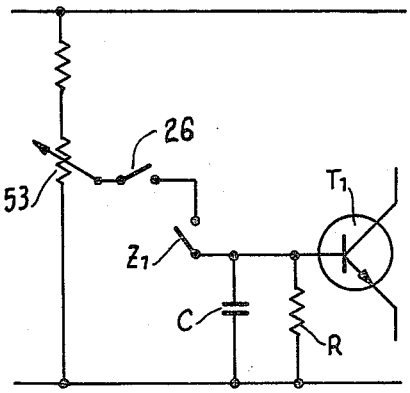
FIG. 7 shows a portion of still another control unit.

The aforediscussed feature that the proximity detector 26 can be incorporated in the control unit 39 is illustrated in FIG. 7. This proximity detector is installed between the potentiometer 53 (which need not be adjustable) and the timer switch Z1. As mentioned before, the timer switch Z1 closes in response to a (defect) signal from the detector 37. The switch 26 opens when the roll 4 completes its downward movement through the combined distance h1+h2. If desired, the timer switch Z1 can be actuated by a relay (not shown) which is energized in response to the transmission of a (defect) signal via switch 26.

An important advantage of the improved method and apparatus is that the braking operation, which is required to reduce the likelihood of damage to lowermost roll 4 during and/or upon completion of movement in the direction to increase the width of clearances between the rolls 3, 5 and 4, is carried out after the roll 4 has already covered the distance h1. This renders it possible to reduce the resistance of valves 44, 45 to the outflow of fluid from the chambers 114A, 214A to a minimum during the interval t1, i.e., the interval t1 is short and, therefore, the likelihood of damage to the roll 4 during downward movement through the distance h1 is much less pronounced than in conventional calenders. The fact that the roll 4 descends beyond the distance h1 is of no consequence; all that counts is to reduce the interval t1 to less than that which is needed in conventional calenders to move the rolls apart to the extent which is necessary to prevent contact between neighboring rolls upon detection of a break in the web W.

Rapid completion of downward movement of the roll 4 through the distance h1 is directly attributable to complete opening of valves 44, 45 in immediate response to transmission of a (defect) signal (from 37). Thus, the roll 4 can descend at the speed which is determined by the force of gravity and is not opposed by fluid in the chambers 114A, 214A. This cannot be achieved in conventional calenders because the lowermost roll, the bearings for such roll and/or the pistons for the bearings strike against stationary abutment means as soon as the lowermost roll covers the distance h1. Moreover, the movement of roll 4 in a direction away from the nearest intermediate roll 5 can be assisted by one or more motors (e.g., by pressurized fluid which is admitted into the chambers 114D, 214D) so that the speed of downward movement of the roll 4 through the distance h1 (or at least through a substantial part of this distance) can exceed that speed which is achieved if the roll 4 is accelerated solely under the action of gravity.

Still further, the distance h2 can be selected almost at will, i.e., it can greatly exceed the distance h1, so as to achieve a gradual and smooth deceleration of the roll 4 to zero speed. In each instance, the distance h2 suffices to avoid undue (or any) flexing of the lowermost roll 4, or of any portion of this roll, as a result of inertia and/or under the action of the force of gravity. This holds true regardless of the weight and/or length of the lowermost roll 4 and/or its bearings, i.e., a very long and extremely heavy roll 4 can be readily decelerated without undue flexing of its median portion, vibrations and/or other undesirable stray movements. Therefore, the useful life of bearings, rolls, spindles, stops and/or other constituents of a calender which embodies the improved apparatus is much longer than the useful life of analogous parts in conventional calenders. Moreover, the parts which compensate for eventual flexing of rolls (if such parts are provided at all) are also unlikely to undergo rapid, pronounced or excessive wear. Still further, the additional downward movement of the lowermost roll 4 through the distance h2 is desirable and advantageous on the ground that it even more reliably prevents any contact between the roll 4 and other rolls of the calender while the roll 4 moves or after the roll 4 completes its movement in a direction away from the other rolls. It has been found that the distance h2 should preferably exceed the distance h1 because this permits resort to decelerating or braking forces which are smaller than the force of gravity. As mentioned before, the distance h2 can be in the range of 1.5–4h1.

An inspection of FIG. 3 will reveal that, while descending through the distance h1, the roll 4 moves at a plurality (i.e., a series) of speeds ranging from zero speed at the point 0 to maximum speed after elapse of the interval t1. Such acceleration of the roll 4 during movement through the major part of or the entire distance h1 is desirable and advantageous because it reduces the interval t1. As mentioned before, the passages which the flow restrictors 44A, 44B define in the fully open positions of the respective valves 44, 45 can be readily selected in such a way that the resistance which the open valves 44, 45 offer to the outflow of hydraulic fluid from the chambers 114A, 214A is zero or close to zero. Consequently, the valves 44, 45 do not oppose the action of the force of gravity upon the roll 4 while the latter moves downwardly through the distance h1.

It is also desirable (see FIG. 3) to decelerate the roll 4 at a constant rate while this roll moves downwardly to cover the major part of or the entire distance h2. The distance h2 can be readily selected in such a way that it barely suffices to prevent excessive flexing of the roll 4 during deceleration to zero speed (point B in FIG. 3). Thus, if it is desired to keep the combined distance h1+h2 to a minimum, the distance h2 will be selected with a view to preventing excessive but to permitting some flexing, vibration and/or other stray movements of the roll 4.

As mentioned above, the distance h2 can be selected with a view to insuring that a selected roll 3, 4 or 5 can be removed from the frame 1 when the roll 4 completes its downward movement through the distance h1+h2. This simplifies the controls of the calender, i.e., a selected roll can be removed and replaced with a new roll as soon as the separation of rolls 3–5 (for the purpose of avoiding damage to the rolls) is completed. In other words, it is not necessary to distinguish between separation for the purpose of reducing the likelihood of damage and separation for the purpose of permitting removal of one or more rolls.

It is also within the spirit of the invention to move the lowermost roll 4 upwardly through the distance h2 as soon as the downward movement through the distance h1+h2 is completed (provided of course, that the roll 4 was not lowered for the purpose of removing a selected roll from the stand 1). This can be achieved by the simple expedient of opening the valve 30 of FIG. 4 as soon as the valves 44, 45 close (i.e., as soon as the roll 4 reaches its lower end position) and closing the valve 30 when the roll 4 completes its upward movement through the distance h2. Closing of the valve 30 can be effected by resorting to a suitable timer mechanism or by installing a detector which transmits a signal when the roll 4 reaches an intermediate position at a distance h1 from the upper end position and at a distance h2 from the lower end position. The roll 4 then remains in such intermediate position of readiness until after the cause of defect is eliminated. An advantage of such modification is that the interval which elapses during movement of the roll 4 back to the upper end position is just as short as in conventional calenders wherein the extent of downward movement of the lowermost roll is limited to the distance h1.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

We claim:

1. A method of rapidly separating the rolls of a calender wherein a row of normally closely adjacent superimposed rolls includes upper and lower outermost rolls and one of the outermost rolls is movable sideways toward and away from the other rolls to respectively reduce and increase the width of clearances between neighboring rolls and wherein the one outermost roll must move through a predetermined distance in order to allow for adequate separation of all rolls which form the row, comprising the steps of (a) moving the one outermost roll through said predetermined distance and in a direction away from the other rolls at a series of first speeds which series includes a succession of progressively higher speeds so that the one outermost roll is accelerated during at least a portion of its movement through said predetermined distance; and (b) continuing the movement of the one outermost roll in said direction at a series of gradually decreasing second speeds and through a second distance which is at least 50 percent of said predetermined distance.

2. The method of claim 1, wherein said one outermost roll is the lower outermost roll and the movement of said lower outermost roll involves a downward movement of such roll.

3. The method of claim 2, further comprising the step of confining a supply of liquid at a level below the lower outermost roll so that the confined liquid normally prevents movements of the lower outermost roll in said direction and the confined liquid is pressurized, at least under the weight of the lower outermost roll.

4. The method of claim 3, wherein said steps (a) and (b) include establishing at least one path for the escape of confined liquid so that the lower outermost roll can descend by gravity, at least said step (b) including regulating the rate of escape of liquid along said path.

5. The method of claim 1, wherein said second distance exceeds said predetermined distance.

6. The method of claim 1, wherein said portion constitutes at least the major part of movement of the one outermost roll through said predetermined distance.

7. The method of claim 1, wherein the speeds of said series of second speeds decrease at a constant rate so that the one outermost roll is decelerated at such constant rate, at least while covering a substantial portion of said second distance.

8. The method of claim 7, wherein said substantial portion constitutes at least the major part of said second distance.

9. The method of claim 1, wherein said step (b) includes gradually decelerating the one outermost roll to zero speed.

10. The method of claim 1, wherein said step (a) includes subjecting the one outermost roll to the action of a pressurized fluid, at least during movement of such roll through a portion of said predetermined distance.

11. The method of claim 1, wherein said series of first speeds includes a maximum speed of at least 20 centimeters per second, said maximum speed being achieved by the one outermost roll during the last stage of movement through said predetermined distance.

12. The method of claim 11, wherein said maximum speed is in excess of 25 centimeters per second.

13. The method of claim 1, further comprising the step of moving the one outermost roll counter to said direction and through a distance which at least approximates said second distance.

14. The method of claim 13, wherein said step of moving counter to said direction includes subjecting the one outermost roll to the action of a pressurized fluid.

15. The method of claim 1, further comprising the step of holding the other outermost roll against sidewise movement in the course of movement of said one outermost roll through said distances.

16. The method of claim 15, wherein said one outermost roll is the lower outermost roll.

17. The method of claim 1, wherein said second distance at least approximates that distance which is needed to permit removal of a selected roll of said row from the calender frame.

18. In a calender, the combination of a row of superimposed rolls including an upper and a lower outermost roll, said lower outermost roll being movable toward and away from the other rolls and said rolls being adequately separable from each other upon movement of said lower outermost roll through a predetermined distance in a direction away from the other rolls; bearing means for said lower outermost roll; displacing means actuatable to effect the movement of said lower outermost roll away from the other rolls, said displacing means comprising hydraulic motor means including a cylinder member and a piston member, one of said members being stationary and the other of said members being movable up and down with said bearing means, said members defining a liquid-containing chamber and said displacing means further comprising adjustable flow restricting means for regulating the evacuation of liquid from said chamber; and control means operative to actuate said displacing means so as to effect the movement of said lower outermost roll in said direction, through said predetermined distance and at a series of increasing first speeds, and immediately thereafter a further movement in said direction, through a second direction which is at least 50 percent of said predetermined distance and at a series of gradually decreasing second speeds, said control means including means for adjusting said flow restricting means.

19. The combination of claim 18, further comprising means for generating signals which initiate the operation of said control means.

20. The combination of claim 19, wherein the sum of said predetermined and second distances at least approximates that distance at which a selected roll of said row can be removed from the calender.

21. The combination of claim 19, wherein said adjusting means includes means for reducing to a minimum value the resistance which said flow restricting means offers to the outflow of liquid from said chamber during movement of said lower outermost roll through said predetermined distance and for gradually increasing the resistance which said flow restricting means offers to the flow of liquid from said chamber during movement of said lower outermost roll through said second distance.

22. The combination of claim 21, wherein said flow restricting means comprises a valve which is adjustable by said control means to prevent the escape of liquid from said chamber so that said one outermost roll is held against movement in said direction as long as said valve prevents the escape of liquid from said chamber.

23. The combination of claim 21, wherein said control means includes means for transmitting signals and said flow restricting means includes an input element which is connected with said control means and is responsive to said signals to change the rate of flow of liquid from said chamber.

24. The combination of claim 23, wherein said signal transmitting means includes means for transmitting a series of signals as a function of time.

25. The combination of claim 24, wherein said rolls are arranged to treat a running web of flexible material and said signal generating means includes means for monitoring the running web and for generating signals to operate said control means on detection of breakage of the running web.

26. The combination of claim 21, wherein said adjusting means further comprises means for monitoring the movements of said lower outermost roll and for initiating said increase of resistance which said flow restricting means offers to the flow of liquid from said chamber when said one outermost roll completes its downward movement through said predetermined distance.

27. The combination of claim 18, wherein said adjusting means includes signal generating means for monitoring the movements of said lower outermost roll and means for increasing the resistance which said flow restricting means offers to the flow of liquid from said chamber in response to that signal from said monitoring means which denotes that said lower outermost roll has completed its movement through said predetermined distance.

28. The combination of claim 18, wherein said hydraulic motor means comprises a plurality of stationary cylinder members and piston members reciprocable in said cylinder members and supporting said bearing means, said adjustable flow restricting means comprising discrete flow restrictors, one for each of said cylinder members.

29. The combination of claim 18, further comprising a source of hydraulic fluid, conduit means connecting said source with said chamber, a shutoff valve in said conduit means, and one-way valve means installed in said conduit means intermediate said chamber and said shutoff valve.

30. The combination of claim 29, further comprising second conduit means for evacuation of liquid from said chamber, said flow restricting means being installed in said second conduit means and said first mentioned conduit means communicating with said chamber via said second conduit means.

31. The combination of claim 18, wherein said rolls are arranged to treat a running web of flexible material and said cylinder member is a double acting cylinder which reciprocably confines said piston member and defines therewith said first mentioned chamber and a second chamber for reception of pressurized fluid which moves said piston member in said direction, and further comprising means for monitoring the tensional stress upon the running web and for generating signals in response to detection of changes in the tensional stress, means for transmitting said signals to said control means to operate said control means, means for coupling said piston member to said lower outermost roll, and means for admitting pressurized fluid into said second chamber to accelerate said lower outermost roll in said direction during movement of said lower outermost roll through said predetermined distance.

32. The combination of claim 18, further comprising means for blocking the movement of said upper outermost roll toward the lower outermost roll during movement of said lower outermost roll in said direction.

33. The combination of claim 32, wherein said blocking means comprises a double-acting fluid-operated cylinder and piston unit having a movable piston coupled to said upper outermost roll and a cylinder defining with said piston a pair of fluid-containing chambers, and means for preventing the flow of fluid from said fluid-containing chambers during movement of said lower outermost roll in said direction.

34. The combination of claim 33, wherein said unit further comprises conduit means communicatively connected with said fluid-containing chambers and said flow preventing means comprises shutoff valve means in said conduit means.

35. The combination of claim 34, wherein said piston of said unit has a piston rod and further comprising bearing means for said upper outermost roll, said piston rod being attached to said bearing means and said shutoff valve means comprising a common shutoff valve for the two chambers of said unit.

36. The combination of claim 18, wherein said row further includes a plurality of intermediate rolls disposed between said outermost rolls, and further comprising discrete bearings for said rolls, a stand for said bearings, at least one upright spindle in said stand, stops provided on said spindle to limit the downward movement of bearings for intermediate rolls during movement of said lower outermost roll in said direction, and braking means interposed between the bearings for said intermediate rolls and the respective stops.

37. The combination of claim 36, wherein said braking means comprises resilient elements.

38. The combination of claim 36, wherein said braking means comprises springs.

39. The combination of claim 36, wherein said braking means comprises shock absorbers.

40. The combination of claim 18, wherein the total number of rolls in said row exceeds five.

41. The combination of claim 18, wherein said second distance exceeds said predetermined distance.

42. The combination of claim 18, wherein said displacing means includes at least one hydraulic motor and said control means is operative to actuate said displacing means in accordance with a predetermined pattern as a function of time.

43. The combination of claim 18, wherein the sum of widths of all clearances which are necessary between the neighboring rolls of said row for adequate separation of such rolls equals said predetermined distance.

44. The combination of claim 18, wherein the highest of said series of first speeds is at least 20 centimeters per second and the lowest of said series of second speeds is zero speed.

45. In a calender, the combination of a row of superimposed rolls including an upper and a lower outermost roll, one of said outermost rolls being movable toward and away from the other rolls and said rolls being adequately separable from each other upon movement of said one outermost roll through a predetermined distance in a direction away from the other rolls; displacing means actuatable to effect the movement of said one outermost roll away from the other rolls; and control means operative to actuate said displacing means so as to effect the movement of said one outermost roll in said direction, through said predetermined distance and at a series of first speeds which series includes a succession of progressively higher speeds so that said one outermost roll is accelerated at least during a portion of its movement through said predetermined distance, and immediately thereafter through a second distance which is at least 50 percent of said predetermined distance and at a series of gradually decreasing second speeds.

* * * * *